US005409397A

United States Patent [19]

Karman

[11] Patent Number: 5,409,397

[45] Date of Patent: Apr. 25, 1995

[54] ADAPTER PLUG

[75] Inventor: Gregg Karman, La Quinta, Calif.

[73] Assignee: Environmental Associates, Inc., Palm Desert, Calif.

[21] Appl. No.: 151,897

[22] Filed: Nov. 15, 1993

[51] Int. Cl.[6] ..... H01R 13/00

[52] U.S. Cl. ..... 439/484; 439/651; 439/105

[58] Field of Search ..... 439/482, 483, 484, 651, 439/476–481, 152, 159, 160, 105

[56] References Cited

U.S. PATENT DOCUMENTS

| | | | |
|---|---|---|---|
| D. 88,337 | 10/1932 | Massey . | |
| D. 92,466 | 4/1934 | Grant . | |
| D. 117,216 | 7/1939 | Clark, Jr. . | |
| D. 148,105 | 7/1946 | Gossard . | |
| D. 154,700 | 3/1948 | Neustadt . | |
| D. 155,149 | 9/1949 | Gossard | 439/483 |
| D. 159,196 | 7/1950 | Englar | 68/17 R |
| D. 185,163 | 5/1959 | Miller . | |
| D. 242,464 | 11/1976 | Acosta | D26/1 B |
| 1,714,763 | 7/1928 | Boyson . | |
| 2,030,115 | 5/1929 | Muldoon | 173/361 |
| 2,507,092 | 12/1944 | Cline | 439/484 |
| 3,242,455 | 3/1966 | Horvath et al. | 439/651 |
| 3,407,377 | 10/1968 | Anderson | 439/483 |
| 3,431,535 | 3/1969 | Munyon . | |
| 3,869,096 | 11/1975 | Miller . | |
| 3,924,914 | 12/1975 | Banner | 439/105 |
| 4,073,564 | 2/1978 | Davis, Jr. | 439/651 |
| 5,062,803 | 11/1991 | Howard | 439/160 |

*Primary Examiner*—David L. Pirlot
*Assistant Examiner*—Hien D. Vu
*Attorney, Agent, or Firm*—Dennison, Meserole, Pollack & Scheiner

[57] ABSTRACT

An adapter plug including a central rectangular body having integral loop handles extending laterally from the opposed sides thereof and defining finger accommodating grips to assist in inserting and removing the adapter from a power source, wall receptacle or the like. Conductor prongs extend from one end of the adapter plug body for engagement within a wall receptacle while the other end of the adapter body includes conductive sockets for the semi-permanent mounting of an appliance plug thereto.

6 Claims, 1 Drawing Sheet

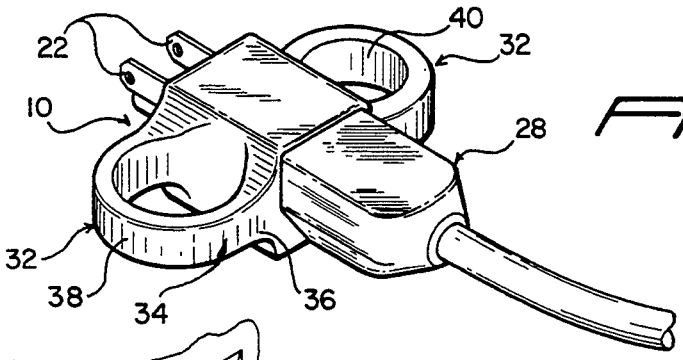
FIG. 1
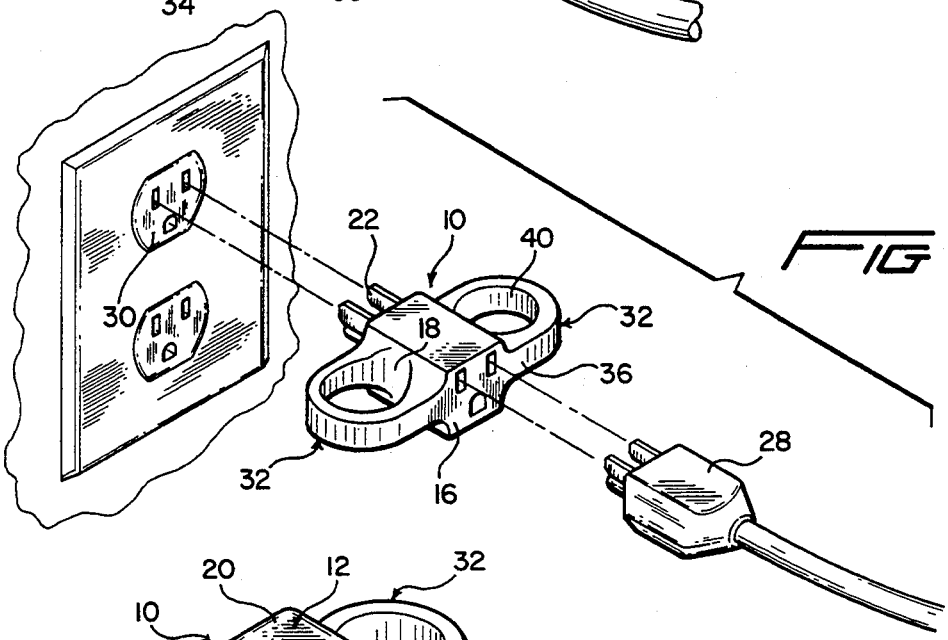
FIG 2
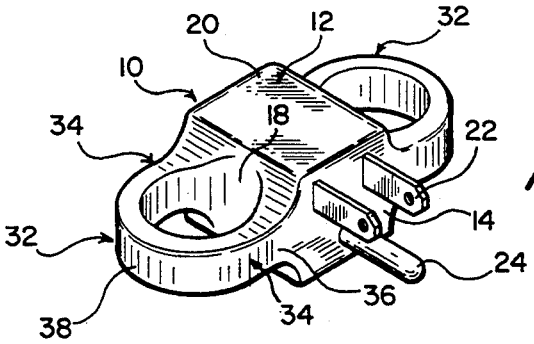
FIG. 3
FIG 4
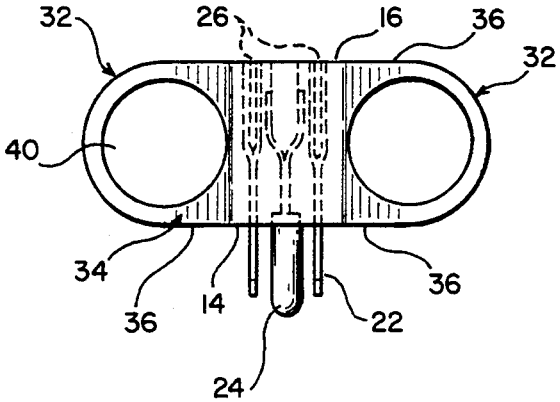
FIG 5
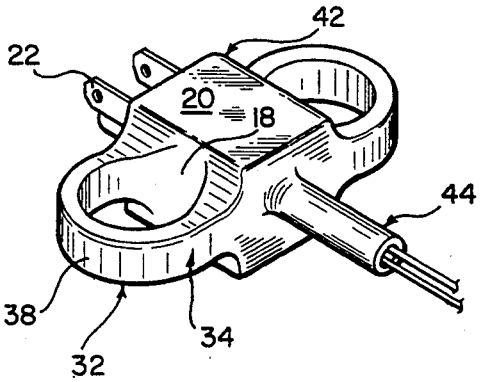

ADAPTER PLUG

BACKGROUND OF THE INVENTION

Electrical plugs for coupling electric appliances to a source of electric power, for example a conventional wall outlet, come in a variety of sizes and shapes, most of which are rather compact and basically of a size only sufficient to mount the necessary blades or prongs and provide a minimal gripping surface. So configured, the plugs are preferably unobtrusive, rather standard in configuration, and normally not particularly formed for ease of insertion and removal.

As such, the conventional electric plug can cause substantial difficulties for the handicapped, infirmed and aged.

As is readily apparent, it is essential that the plug be smoothly inserted and removed, and that no contact be made with the exposed partially inserted blades or prongs. For those unable to properly grasp a plug, particularly for the withdrawal thereof, it is not uncommon for one to unthinkingly attempt to insert a finger or some implement between the plug and the wall in an effort to pry the plug from the wall. The results thereof can obviously be disastrous.

SUMMARY OF THE INVENTION

The present invention proposes an electric adapter plug which will mount, either permanently or semi-permanently, to an original equipment plug, for example on an appliance of any type, a piece of equipment, or even an extension cord. When so mounted, the adapter plug now functions as the principal plug which is in turn selectively engaged with and disengaged from the power source.

The significance of what amounts to a substitute of the adapter plug for the original appliance plug is in the specific formation of the adapter plug which ensures that it can be properly manipulated by those, such as the elderly, infirmed or handicapped, who would otherwise be unable, or only with great difficulty, to manipulate a conventional plug.

Thus, as one's physical circumstances might change, either temporarily or permanently, the ability to perform the normally simple tasks of plugging or unplugging an electric appliance, for example a vacuum cleaner, radio or kitchen utensil, can be easily retained.

Basically, the adapter includes a non-conductive plug body with a flat leading end from which the blades and/or prongs project. For example, in a grounded plug, two conductive blades will be provided along with a relatively longer grounding plug. It will of course be appreciated that the blade arrangement, whether with or without a grounding plug, can vary in accord with the particular purpose to which the adapter is to be put.

The opposed end of the plug body, that is the following or outer end thereof, is also planar and provided with conductive sockets defined therein in accord with the blades and prongs on the leading end.

The manipulation of the adapter plug, readily and without difficulty, is made possible by incorporating therein a pair of finger accommodating loops, one defined to each side of the main body of the plug and laterally outward to the opposed sides of the plug blades and opposed sockets. Thus, disengagement of the adapter plug from a wall receptacle requires only the insertion of two fingers of one hand, or for that matter one finger of each of two hands, into the two loops and outwardly retracting the plug from the receptacle, thus disconnecting the adapter plug, along with the appliance plug affixed thereto. The slight outward positioning of the finger loops to the opposite sides of the blades also provides a minor degree of leverage should it become necessary to slightly wobble the plug as the plug is being withdrawn if a particularly tight interlock is involved.

Similarly, insertion of the adapter into a wall receptacle is simplified by the increased bearing area defined by the laterally projecting loops with the fingers either engaged in the loops when inserting the adapter plug, or actually bearing against the planar outer faces of the end portions of the loops which extend from the outer or socket face of the adapter.

While particularly intended for use as an adapter for the conversion of standard appliance plugs, the features of the adapter plug may, for special environment equipment, as for appliances specifically intended for nursing homes and the like, be used as an original equipment plug with a power cord directly engaged therewith.

Additional features, objects and advantages of the invention are considered to reside in the details of construction and manner of use of the invention as more fully hereinafter described and claimed.

BRIEF DESCRIPTION OF THE DRAWINGS

FIG. 1 is a perspective view of the adapter plug mounted to an appliance plug for use thereof as the primary means for directly engaging and disengaging the appliance wire with a wall receptacle;

FIG. 2 is an exploded perspective view illustrating the relationship between the appliance plug and the adapter plug of the invention, and a wall receptacle defining the conventional power source;

FIG. 3 is a perspective view of the adapter plug from the leading or blade face thereof;

FIG. 4 is a side elevational view of the adapter plug illustrating, in phantom lines, the relationship between the blades and opposed sockets; and FIG. 5 illustrates a variation wherein the adapter plug can, under special equipment situations, be formed directly with the conductor cable.

DESCRIPTION OF PREFERRED EMBODIMENTS

The electrical adapter plug 10 of the invention is formed of a non-conductive material, preferably molded to define a rectangular central body 12 having a planar leading end 14, a planar following end 16, opposed planar sides or side walls 18, and opposed planar front and rear faces or walls 20.

Electrically conductive elements, preferably a pair of conductive blades 22 and a grounding plug 24 are imbedded within the central body 12 and project from the planar leading end 14 thereof. As suggested in FIG. 4, cooperating communicating sockets 26 are defined within and accessible through the opposed planar following end 16. So configured, the adapter plug 10 is particularly adapted for interposition between a conventional appliance plug 28 and a power source such as the illustrated wall receptacle 30. It will be appreciated that the nature, number and configuration of the blades and/or prongs, and associated sockets, can vary in accord with the requirements of the particular appliance plug 28 and receptacle 30.

The principal purpose of the electrical adapter plug 10 of the invention is to adapt the conventional appliance plug 28 for more ready and positive manipulation, particularly by the infirm and particularly under those circumstances wherein the appliance is to be frequently plugged and unplugged relative to a wall receptacle 30 or the like. As such, the adapter is intended to be permanently or semi-permanently mounted to the appliance plug 28. The facilitated manipulation is achieved by the formation of the adapter plug 10 with two integrally molded closed finger loops or loop handles 32 extended respectively from the opposed planar side walls 18 of the body.

Each loop handle includes a pair of opposed end portions 34 which are integrally joined to the corresponding side wall 18 and project perpendicularly therefrom with the outer faces 36 of these end portions being coplanar with the corresponding planar forward and following ends 14 and 16 of the body 12. Each loop 32 is completed by an arcuate bight portion 38 which defines, with the end portions 34, a circular finger receiving aperture 40.

The loops or loop handles 32 are narrower than the body, that is of less thickness than the thickness of the body between the front and rear walls 20. Further, the opposed end portions 34 of each of the loops 32 are outwardly flared or enlarged at the integral joinder to the corresponding body side 18.

As best seen in FIG. 4, the finger apertures 40 defined by the loop handles 32 are positioned laterally outward of the blades and prongs and positioned to equalize the withdrawal pressure to each side thereof, and in fact allow for slight "wiggling" of the adapter plug should such be necessary to facilitate loosening of a particularly tight joinder.

The planar leading and following ends 14 and 16, as well as the planar outer faces 36 of the end portions 34 of the loops 32, which do not project beyond the planar ends 14 and 16, provide for a minimal thickness adapter plug 10 which both engages flush against the power source receptacle 30 and in turn receives the appliance plug 28 flush thereagainst. As such, the adapter, while uniquely providing for handles on the appliance plug, adds little to the actual bulk thereof and can easily be retained on the plug in a semi-permanent manner without interfering with normal use of the appliance cord, including the storing thereof during periods of nonuse.

It will be appreciated that the loop handles 32 are so oriented as to extend to the lateral sides of the receptacle 30 so as to not interfere with use of a companion receptacle positioned thereabove or therebelow as in a duplex outlet. Similarly, the opposed planar front and rear walls 20 which, as oriented in the drawings, constitute upper and lower faces or walls for the adapter body 12, are also so formed and projection free as to not interfere with an adjacent adapter in an adjoining receptacle 30.

Referring now to FIG. 5, a variation has been illustrated therein wherein the adapter plug 42 is modified for use as an original equipment plug by providing for a mounting of the plug 42 directly to the appliance cord 44, as opposed to the provision of the conductive sockets 26. Such a use would find particular adaptability when involved in special circumstances using other than conventional appliances, particularly appliances which are intended for use only by the infirmed, thus justifying utilizing the relatively more expensive adapter plug of the invention as the original equipment plug.

The foregoing is illustrative of the principals of the invention, and the disclosed embodiments are not to be considered as limitations on the scope of the invention. Rather, the invention is to be only limited by the scope of the claims following hereinafter.

I claim:

1. An electric plug comprising a generally rectangular configured body of molded electrically insulative material, said body having a planar leading end, electrically conductive blades fixed within said body and extending from said planar leading end for insertion of said electric plug into a cooperating electrically conductive socket means, said body comprising a planar following end paralleling said leading end, said following end having electrically conductive means defined thereat and in engagement with said conductive blades for transfer of electric current, said body further comprising substantially planar opposed front and rear walls substantially parallel to each other and between said leading end and said following end, said body also having opposed side walls substantially perpendicular to said front and rear walls and in between said leading and following ends, a pair of closed gripping loops, one of said gripping loops extending outwardly from each side wall of said body, each loop having opposed first and second end portions integral with a corresponding side wall of said body and respectively adjacent said leading and following ends of said body, said first end portions having outer faces substantially parallel and coplanar with said planar leading end to define a continuous planar surface, said second end portions having outer faces substantially parallel and coplanar with said planar following end and defining a continuous planar bearing surface with said planar following end for facilitating plug insertion, said continuous planar surfaces at said leading and following ends being parallel.

2. The electric plug of claim 1 wherein said electrically conductive means defined at said planar following end comprises conductive sockets recessed inward of said planar following end, said planar following end being free of projections for reception of an appliance plug or the like wherein said electric plug defines a handled adapter for said appliance plug.

3. The electric plug of claim 2 wherein said leading end includes a ground prong fixed therein and cooperatively associated with said conductive blades.

4. The electric plug of claim 1 wherein said opposed side walls of said body are planar and parallel to each other.

5. The electric plug of claim 1 wherein said electrically conductive means defined at said planar following end comprises a conductor cord fixed within and extending from said planar following end.

6. An appliance plug comprising an electrically insulative body having a generally rectangular configuration and including opposed substantially planar front and rear walls, a planar leading end with conductive blades extending therefrom for insertion of said appliance plug into a source of electricity, said body having a planar following end substantially paralleling said leading end and including a conductor cord extending from said planar following end, said planar following end being free of projections other than for said conductor cord, said body including opposed side walls substantially perpendicular to said front and rear walls and a pair of closed loop handles, each of said closed loop handles extending integral from one of said side walls and projecting laterally therefrom to define a lateral plug length comprised of the respective length of said body and said loop handles; said loop handles defining finger receiving apertures therethrough, each of said loop handles including spaced first and second end portions engaged to and extending from a corresponding side wall respectively adjacent said leading and following ends of said body and joined by a bight portion outwardly spaced from said corresponding side wall, said first end portions having outer faces substantially parallel and coplanar with said planar leading end of said body and defining a continuous planar surface therewith and for a major portion of the lateral plug length, said second end portions having outer faces substantially parallel and defining a substantially continuous planar bearing surface therewith, wherein said bearing surfaces substantially parallel each other.

* * * * *